US010181639B2

(12) United States Patent
Naito et al.

(10) Patent No.: US 10,181,639 B2
(45) Date of Patent: Jan. 15, 2019

(54) ANTENNA DEVICE

(71) Applicant: Mitsubishi Electric Corporation, Chiyoda-ku (JP)

(72) Inventors: Teruki Naito, Chiyoda-ku (JP); Yukihisa Yoshida, Chiyoda-ku (JP); Shingo Yamaura, Chiyoda-ku (JP); Hayato Ogino, Chiyoda-ku (JP); Yuichiro Fukuma, Chiyoda-ku (JP)

(73) Assignee: Mitsubishi Electric Corporation, Chiyoda-ku (JP)

( * ) Notice: Subject to any disclaimer, the term of this patent is extended or adjusted under 35 U.S.C. 154(b) by 0 days.

(21) Appl. No.: 15/519,658

(22) PCT Filed: May 15, 2015

(86) PCT No.: PCT/JP2015/064041

§ 371 (c)(1),
(2) Date: Apr. 17, 2017

(87) PCT Pub. No.: WO2016/075956

PCT Pub. Date: May 19, 2016

(65) Prior Publication Data

US 2017/0264006 A1 Sep. 14, 2017

(30) Foreign Application Priority Data

Nov. 14, 2014 (JP) ..... 2014-231675

(51) Int. Cl.
*H01Q 11/12* (2006.01)
*H01Q 1/26* (2006.01)
*H01Q 1/36* (2006.01)

(52) U.S. Cl.
CPC ..... *H01Q 1/26* (2013.01); *H01Q 1/366* (2013.01)

(58) Field of Classification Search
CPC ..... H01Q 1/26; H01Q 1/366; H01Q 1/36
(Continued)

(56) References Cited

U.S. PATENT DOCUMENTS 2,557,961 A 6/1951 Goldstein et al.
3,155,924 A 11/1964 Kaufman et al.
(Continued)

FOREIGN PATENT DOCUMENTS

JP 8-139506 A 5/1996
JP 2002-527920 A 8/2002
JP 2010-148025 A 7/2010

OTHER PUBLICATIONS

International Search Report dated Aug. 11, 2015, in PCT/JP2015/064041, filed May 15, 2015.
(Continued)

*Primary Examiner* — Jean B Jeanglaude
(74) *Attorney, Agent, or Firm* — Oblon, McClelland, Maier & Neustadt, L.L.P.

(57) ABSTRACT

An antenna device includes a ground conductor (1), a dielectric tube (2) containing an ionizing gas and passing through the ground conductor, whose folded-back portion (201) and both ends are disposed in different sides of the ground conductor, first electrodes (3, 4) disposed at both ends of the dielectric tube (2), a plasma excitation power supply connected to the first electrodes, bringing the ionizing gas into a plasma state; a second electrode (6) ring-shaped and disposed at the both ends side of dielectric tube (2) from the ground conductor (1), fitted to and in contact with the dielectric tube outer surface, a high frequency transmitter (7) supplying a high frequency signal to the second electrode (6), and a feed line (8) connecting the second electrode and the high frequency transmitter. Each
(Continued)

end of the dielectric tube (2) is larger than the second electrode in the inner diameter.

14 Claims, 10 Drawing Sheets

(58) Field of Classification Search
USPC ..... 343/767, 741, 708
See application file for complete search history.

(56) References Cited

U.S. PATENT DOCUMENTS

| | | | | |
|---|---|---|---|---|
| 4,989,013 | A * | 1/1991 | Smith, II | H01Q 1/06 343/708 |
| 5,175,560 | A * | 12/1992 | Lucas | H01Q 13/085 343/767 |
| 5,594,456 | A | 1/1997 | Norris et al. | |
| 5,990,837 | A | 11/1999 | Norris et al. | |
| 6,087,992 | A | 7/2000 | Anderson | |
| 6,221,094 | B1 | 4/2001 | Bare | |
| 6,492,951 | B1 | 12/2002 | Harris et al. | |
| 2003/0160724 | A1 | 8/2003 | Alexeff et al. | |

OTHER PUBLICATIONS

Anderson, et al., "An Operating Intelligent Plasma Antenna", 16th IEEE International Pulsed Power Conference, vol. 1, 2007, p. 353-356.

Schmitt, "Plasma resonances excited by antennas", Proceedings of the IEEE, vol. 52, No. 5, 1964, p. 622-623.

Buharov, et al., "Plasma Loop Antenna—Computing and Experimental Research", 2014 International Conference on Mathematical Methods in Electromagnetic Theory (MMET), IEEE, Aug. 2014, p. 183-186.

Takahagi, et al., "Study on Radar Cross Section for the Plasma Antenna in UHF Band", Proceedings of Asia-Pacific Microwave Conference 2014, Nov. 4-7, 2014, p. 974-976.

Office Action dated Jan. 26, 2016 in Japanese Patent Application No. 2015-548532 (with unedited computer generated English translation).

John Phillip Rayner, et al., "Physical Characteristics of Plasma Antennas", IEEE Transactions on Plasma Science, vol. 32 No. 1, Feb. 2004, pp. 269-281.

G. Cerri, et al., "Plasma Antenna Characterization", IEEE, 2005, pp. 1-4.

* cited by examiner

ANTENNA DEVICE

TECHNICAL FIELD

The present invention relates to an antenna device in which the interference with a radio wave is reduced at a time when the antenna device is not used.

BACKGROUND ART

Generally, a metallic antenna interferes with a radio wave existing in the surroundings even when the metallic antenna is not used, thereby causing, scattering of the radio wave. For this reason, in a case in which a plurality of antennas are disposed in a region having a shorter length than the wavelength of a radio wave to be used, the antenna characteristics get worse due to the interference between adjacent antennas. Therefore, it is desirable that the degree of interference between an antenna and a radio wave is small at a time when the antenna is not used.

To this end, conventionally, an antenna device in which an antenna is not formed of a metallic material, and is made to be transparent electrically at a time when the antenna is not used, thereby reducing the interference with a radio wave at a time when the antenna is not used, has been proposed (for example, refer to Patent Literature 1). In the conventional antenna device disclosed in Patent Literature 1, a dielectric tube having a pair of electrode terminals arranged in a place near an earth plate, and containing an ionizing gas between the electrode terminals is disposed, and electric power is supplied from an external power supply to the pair of electrode terminals. As a result, the ionizing gas which enters a plasma state acts as a conductor for high frequency radio waves. In this state, by feeding a high frequency current from the high frequency power supply to the pair of electrode terminals, the dielectric tube operates as an antenna. Due to this configuration, since the dielectric tube serves as a simple dielectric substance at a time when the antenna device is not used, even in a case in which another antenna is disposed adjacent to the antenna device in the surroundings, the antenna device does not become an interference source providing a significant degree of interference for the other antenna.

CITATION LIST

Patent Literature

Patent Literature 1: Japanese Unexamined Patent Application Publication No. 2010-148025

SUMMARY OF INVENTION

Technical Problem

Generally, because a resonance phenomenon of a radio wave (high frequency signal) is used in an antenna, the antenna length is dependent on the wavelength of the radio wave. Since the entire dielectric tube is used as an antenna in a conventional antenna device, the electrode terminals disposed at the both ends of the dielectric, tube also construct a part of the antenna.

In order to make the plasma operate as an antenna, it is necessary to feed a certain amount of discharge current through the plasma. However, because there is an upper limit on the value of the current which can be fed stably through unit surface area of each electrode terminal, when the electrode surface area is small and therefore the current density is large, the life of the electrode terminal becomes short, and, at the worst, this results in breakage of the dielectric tube. Therefore, in order to ensure that each electrode has an electrode surface area which makes it possible for an adequate amount of discharge current to flow therethrough, at least the inner diameter of the dielectric tube needs to be larger than or equal to 10 mm. On the other hand, in order to cause the dielectric tube to operate as an antenna in a high frequency hand, it is necessary to make the inner diameter of the dielectric tube sufficiently smaller than the wavelength of the high frequency signal (for example, when the frequency of the radio wave is 5 GHz, the inner diameter of the dielectric tube is made to be smaller than or equal to 6 mm).

Therefore, in the conventional antenna device using the entire dielectric tube as an antenna, when the size of the dielectric tube is designed to be smaller for using higher radio wave frequency, the size of each electrode terminal becomes smaller and therefore the current required for the plasma to operate as an antenna cannot be fed sufficiently. As a result, a problem occurs that a plasma antenna cannot be implemented in a high frequency band (for example, in a microwave band).

The present invention is made in order to solve the above-mentioned problem, and it is therefore an object of the present invention to provide an antenna device that does not have to change the size of each electrode terminal used for plasma excitation in accordance with the wavelength of a radio wave, and that has a low degree of interference with the radio wave at a time when the antenna device is not used, also in a high frequency band.

Solution to Problem

According to the present invention, there is provided an antenna device including: a ground conductor; a dielectric tube in which an ionizing gas is contained and having a folded-back portion, with both ends of the dielectric tube being directed toward an identical direction, and being arranged to pass through the ground conductor in such away that the folded-hack portion and the both ends are disposed in different sides of the ground conductor; first electrode terminals disposed at the both ends of the dielectric tube, respectively; a plasma excitation power supply connected to the first electrode terminals and bringing the ionizing gas into a plasma state; a second electrode terminal ring-shaped and disposed at a side the dielectric tube in a side of the both ends of the dielectric tube with respect to the ground conductor, and is fitted to an outer surface of the dielectric tube in such a way as to be in contact with the cuter surface; a high frequency transmitter supplying a high frequency signal to the second electrode terminal; and a feed line connecting between the second electrode terminal and the high frequency transmitter, wherein each of the both ends of the dielectric tube has an inner diameter larger than an inner diameter of the second electrode terminal.

Advantageous Effects of Invention

Because the antenna device according to the present invention is configured as above, it is not necessary to change the size of each electrode terminal used for plasma excitation in accordance with the wavelength of the high frequency signal, and an electric current adequate for causing the dielectric tube to operate as an antenna can be fed through the dielectric tube. Therefore, the antenna device can be made to have a low degree of interference with a radio wave at a time when the antenna device is not used, also in a high frequency band.

BRIEF DESCRIPTION OF DRAWINGS

FIG. 5A is a diagram showing a simulation model, and FIG. 5B as a diagram showing a result of the evaluation (a magnetic field distribution);

FIG. 6A is a diagram showing a simulation model, and FIG. 6B is a diagram showing a result of the evaluation (a magnetic field distribution);

DESCRIPTION OF EMBODIMENTS

Hereafter, some preferred embodiments of the present invention will be explained in detail with reference to the drawings.

Embodiment 1

Figure 1:
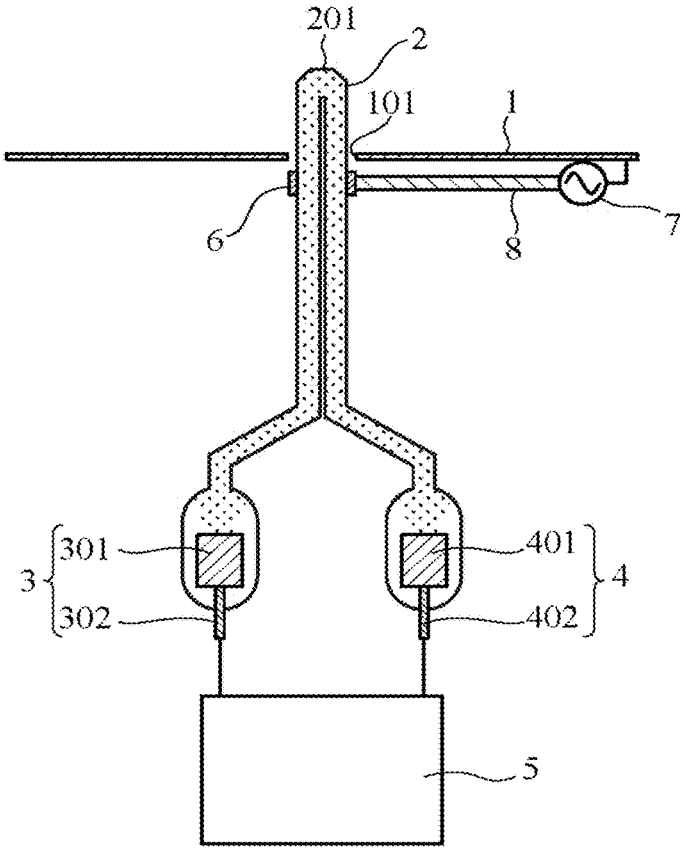
FIG. 1 is a cross-sectional view showing a configuration of an antenna device according to Embodiment 1 of the present invention.
Figure 2:
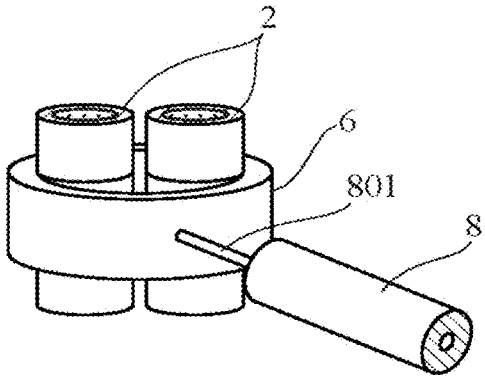
FIG. 2 is a schematic diagram showing a connecting portion between a second electrode terminal and an electric feed line in the antenna device according to Embodiment 1 of the present invention.

FIG. 1 is a cross-sectional view showing a configuration of an antenna device according to Embodiment 1 of the present invention, and FIG. 2 is a schematic diagram showing a connecting portion between a second electrode terminal 6 and a feed line 8.

A ground conductor 1 having a hole 101 is posed in the antenna device according to Embodiment 1, as shown in FIG. 1. A dielectric tube 2 is arranged to pass through the hole 101 of the ground conductor 1, and an ionizing gas is filled in the dielectric tube 2 in such a way that the ionizing gas does not leak out. This dielectric tube 2 has a folded-back portion 201 at at least one part thereof, and both ends of the dielectric tube are directed toward an identical direction. The dielectric tube 2 is arranged to pass through the ground conductor 1 in such a way that the folded-back portion 201 and the both ends of the dielectric tube 2 are disposed in both sides of a boundary plane defined by the ground conductor 1 in the vertical direction. In the example of FIG. 1, the dielectric tube is formed into a U shape (monopole antenna shape), the folded-back portion 201 is disposed on an upper side in the vertical direction of the ground conductor 1, and the both ends are disposed on a lower side in the vertical direction of the ground conductor 1.

Further, as the ionizing gas filled in the dielectric tube 2, an inactive gas containing a rare gas as its main ingredient is used. It is enough for the ionizing gas to contain at least one of the following types of gases: helium (He), neon (Ne), argon (Ar), xenon (Xe), and krypton (Kr), as the rare gas. Further, mercury (Hg) may be filled into the dielectric tube together with the rare gas, in order to increase the discharge efficiency. The pressure of the ionizing gas is designed to fall within a pressure range which makes it possible to maintain a stable glow discharge, and can be set to a range between 10 Pa to 15 k Pa. In order to use the antenna device as a plasma antenna particularly in a microwave band and a millimeter wave band (300 MHz to 300 GHz), it is preferable that the pressure of the ionizing gas falls within a range from 100 Pa to 7 k Pa which makes it possible to provide a high electron density.

Further, as the material of the dielectric tube 2, for example, a material having electric insulation, such as a ceramic material like quartz, borosilicate glass or alumina, a composite material like carbon fiber reinforced plastic, or a material which is a combination of them, is used.

The length of the portion of the dielectric tube 2 from an upper surface of the ground conductor 1 to the folded-back portion 201 is an odd multiple of the quarter of the wavelength of a radio wave (high frequency signal). Further, the gap between the two dielectric tubes 2 which are arranged to be adjacent to each other by folding the dielectric tube 2 is sufficiently shorter than the wavelength of the high frequency signal, and it is preferable that the gap is one-tenth or less of the wavelength. By making the gap between the two dielectric tubes 2 at the folded tube portion shorter than the wavelength, the plasma in the two dielectric tubes 2 at the folded tube portion can be assumed to be approximately a single conductor with respect to the high frequency signal. The peripheral length of the two dielectric tubes 2 at the folded tube portion is made to be one-half or less of the wavelength in order to prevent the resonance of the high frequency signal in the peripheral part of the dielectric tube 2.

Further, a pair of first electrode terminals 3 and 4 is disposed at the both ends of the dielectric tube 2. These first electrode terminals 3 and 4 are composed of discharge electrodes 301 and 401 disposed within the both ends of the dielectric tube 2, and lead wires 302 and 402 having ends connected to bottom portions of the discharge electrodes 301 and 401, and other ends led outside the dielectric tube 2.

As the material of the discharge electrodes 301 and 401, for example, materials used as the cathode of a discharge tube, such as nickel (Ni) or tungsten (W), can be used. As the shape of the discharge electrodes 301 and 401, a shape, such as a solid cylindrical shape, a hollow cylindrical shape, a closed-bottom and open-top shape (cup-like shape), a spiral shape, a coil-like shape, or a filament-like shape, which is produced by using a known method, such as bending of a plate material, injection molding, or welding or swaging of a material, can be used. Further, by configuring the discharge electrodes 301 and 401 in such a way that each of them has a gap of 1 to 5 mm, the discharge efficiency can be improved using the hollow cathode effect. Further, by applying electron emission substance, which is not shown in drawings, to the surfaces of the discharge electrodes 301 and 401, the discharge efficiency can be improved.

Further, the surface areas of the discharge electrodes 301 and 401 are designed to be large to the extent that the discharge current per unit area and per unit gas pressure satisfies a stable discharging condition in each of the discharge electrodes 301 and 401. For example, when the discharge electrodes 301 and 401 are used as cold cathodes, each of the discharge electrodes 301 and 401 may be formed to have a surface area which causes the discharge current per unit area and per unit gas pressure to have a value ranging from 1E-7 to 1E-5 mA/cm2·Pa2. By forming the discharge electrodes in such a way that each of the discharge electrodes has such a surface area, plasma can be generated with stability. It is possible to discharge electricity even when each of the discharge electrodes has a surface area smaller than or equal to the above-mentioned surface area. However, the life of the discharge electrodes 301 and 401 becomes short because the discharge electrodes 301 and 401 become damaged due to the sputtering of the electrode surfaces and the thermalization (arc) of the plasma.

Further, the lead wires 302 and 402 are made from a conductive material whose thermal expansion coefficient is close to that of the material which constructs the dielectric tube 2, in order to ensure the airtightness of the ends of the dielectric tube 2. For example, in a case in which the dielectric tube 2 is made from hard glass, molybdenum (Mo), tungsten (W) or the like can be used as the material of the lead wires. Although in the example of FIG. 1 only one wire is illustrated as each of the lead wires 302 and 402, at each of the ends of the dielectric tube 2, two or more lead wires 302 and two or more lead wires 402 can be disposed in the case of using the discharge electrodes 301 and 401 as hot cathodes.

The both ends of the dielectric tube 2 are configured so as to be able to accommodate the discharge electrodes 301 and 401 within the dielectric tube 2, and each of the both ends has an inner diameter larger than that of the second electrode terminal 6 which will be described later. The inner diameters of the both ends of the dielectric tube 2 can be freely determined under the condition that the dielectric tube 2 can accommodate the discharge electrodes 301 and 401, respectively, and the inner diameters of the both ends may differ from each other. When plasma is generated with direct current power, the durability of the dielectric tube 2 can be improved by increasing the sizes of the discharge electrodes 301 and 401 and the inner diameter of the dielectric tube 2 which are cathodes.

Further, in the example of FIG. 1, the both ends of the dielectric tube 2 are apart from each other. However, the both ends of the dielectric tube 2 may be disposed closer to each other. By making the both ends of the dielectric tube 2 closer to each other, since the occupation area required for installing the antenna device can be reduced, when a plurality of antenna devices according to this embodiment are disposed adjacent to one another and made to operate, it is possible to make the gap between adjacent antenna devices narrower.

Further, a plasma excitation power supply 5 to bring the ionizing gas contained in the dielectric tube 2 into a plasma state is connected to the lead wires 302 and 402 via a pair of wires. Low frequency power for exciting the plasma is supplied from the plasma excitation power supply 5. As the frequency of the low frequency power, a frequency ranging from direct current to the frequency of the radio wave (high frequency signal) can be used. Further, the low frequency power can be supplied intermittently. By supplying the low frequency power intermittently, the low frequency power required to maintain the plasma can be reduced.

Further, the ring-shaped second electrode terminal 6 is disposed at the side of the both ends of the dielectric tube 2 with respect to the ground conductor 1, and is fitted to an outer surface of the dielectric tube 2 in such a way as to be in contact with the outer surface. In the example shown in FIGS. 1 and 2, a single second electrode terminal 6 is disposed for the two dielectric tubes 2 at which the dielectric tube 2 is folded via the folded-back portion 201 to form a two-tubes portion. The gap between a lower surface of the ground conductor 1 and an upper end of the second electrode terminal 6 is designed to be short within the limits in which the ground conductor 1 and the second electrode terminal 6 are not in contact with each other. Particularly, in order to supply the high frequency signal to the plasma efficiently, it is preferable that the gap between the lower surface of the ground conductor 1 and the upper end of the second electrode terminal 6 is one-twentieth or less of the wavelength of the high frequency signal. The second electrode terminal 6 is made to have a small thickness falling within a range of 0.1 mm to 0.5 mm which can be formed by machine work.

Further, in order to avoid the phase distribution of the high frequency signal on the second electrode terminal 6, the height of the second electrode terminal 6 is made to be sufficient shorter than the wavelength of the high frequency signal, and it is preferable that the height of the second electrode terminal is one-tenth or less of the wavelength of the high frequency signal. As the material of the second electrode terminal 6, any material having a low resistance for the high frequency signal can be used. For example, a material, such as copper (Cu) or aluminum (Al), can be used.

This second electrode terminal 6 is connected to a high frequency transmitting unit 7 via the feed line 3, as shown in FIG. 1. The high frequency transmitting unit 7 supplies a high frequency signal to the second electrode terminal 6. As the feed line 8, a normal high frequency transmission line, such as a coaxial cable or a microstrip line, can be used. The feed line 8 is connected to the second electrode terminal 6 via a signal line 801, by a connecting means of providing a low resistance for the high frequency signal. As the connecting means, for example, a typical connecting means, such as soldering, welding or contact using screw clamp, can be used.

A high frequency signal which is to be emitted as a radio wave from the antenna device is supplied from the high frequency transmitting unit 7. As the frequency band of the high frequency signal, a frequency band in which the electric power propagates in the same way as a radio wave can be used. Concretely, the above-mentioned action can be acquired for high frequency signals of frequencies higher than or equal to those of medium frequency waves (300 to 3,000 kHz) used in AM broadcasts or the like. This embodiment is effective particularly in a microwave band of 2 GHz or higher in which wavelengths are short and the surface areas of the first electrode terminals 3 and 4 cannot be sufficiently ensured.

Next, the principle of the operation of the antenna device according to Embodiment 1 shown in FIG. 1 will be explained.

First, a state in which the plasma excitation power supply 5 is turned ON will be explained. In the antenna device shown in FIG. 1, with respect to the boundary formed by the ground conductor 1, an upper portion operates as an antenna operation unit (a transmission unit of a radio wave) while a lower portion operates as both a feeding portion for feeding electric power for plasma excitation to plasma, and a feeding portion for feeding a high frequency signal.

In the state in which the plasma excitation power supply 5 is turned ON, electric power (low frequency power) for exciting plasma is supplied from the plasma excitation power supply 5 to the first electrode terminals 3 and 4. The ionizing gas in the dielectric tube 2 then enters a plasma state, and the dielectric tube 2 serves as a conductor at high frequencies. This conductor is referred to as a plasma conductor.

On the other hand, a high frequency signal from the high frequency transmitting unit 7 is supplied to the second electrode terminal 6 via the feed line 8. The high frequency signal supplied to the second electrode terminal 6 is supplied to the plasma in the dielectric tube 2 which serves as the plasma conductor. The high frequency signal supplied to the plasma propagates toward the upper and lower sides of the dielectric tube 2. The high frequency signal then forms a high frequency electromagnetic field between the plasma and the upper surface of the ground conductor 1, and is emitted into space as a radio wave.

The antenna device according to the present invention is configured in such a way that the first electrode terminals 3 and 4 for plasma excitation and the second electrode terminal 6 for high frequency power supply are disposed apart from each other, thereby being able to supply a high frequency signal to the plasma just below the ground conductor 1. As a result, in the antenna device, the dielectric tube 2 can be partially used as an antenna, which is different from a conventional configuration. Therefore, the inner diameter of the dielectric tube 2 can be designed to be different at each portion thereof in such a way that portions closer to the first electrode terminals 3 and 4 satisfy conditions for plasma and in such a way that a portion closer to the second electrode terminal 6 satisfies conditions for high frequencies. As a result, the diameters of the both ends of the dielectric tube 2 can be increased regardless of the wavelength of the radio wave, and certain surface areas of the first electrode terminals 3 and 4 can be ensured.

Next, a state in which the plasma excitation power supply 5 is turned OFF will be explained.

In the state in which the plasma excitation power supply 5 is turned OFF, the dielectric tube 2 simply serves as a dielectric substance, not as a conductor. Therefore, the most of a high frequency signal supplied via the feed line 8 is reflected by an end edge of the second electrode terminal 6, and the antenna device enters a state in which the impedance matching of the antenna cannot be established. Therefore, the amount of emission of a radio wave in the emission zone becomes very small.

Thus, an antenna device in which the interference with a radio wave is small in the high frequency band (e.g., a microwave band) at a time when the antenna device is not used can be obtained.

Figure 3:
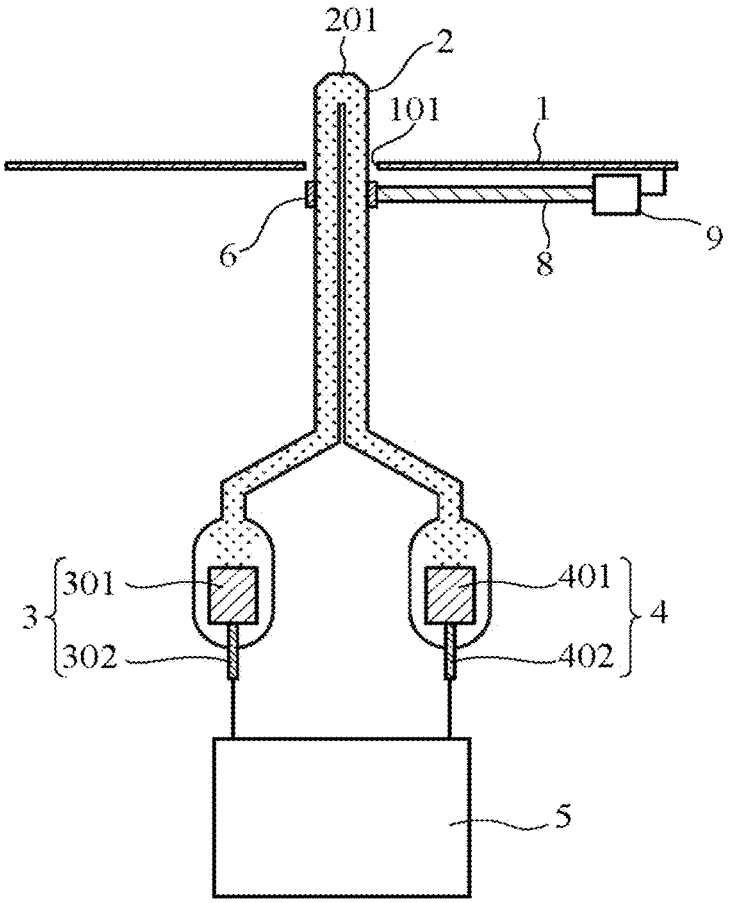
FIG. 3 is a cross-sectional view showing another example of a configuration of an antenna device according to Embodiment 1 of the present invention (in a case of using the antenna device as a receiving device)

In the above-mentioned example, the antenna device is used as a transmitting antenna device. Alternatively, the antenna device can be used as a receiving antenna device. In this case, as shown in FIG. 3, instead of the high frequency transmitting unit 7 shown in FIG. 1, a high frequency receiving unit 9 to receive a high frequency signal from the second electrode terminal 6 is connected to the feed line 8. As an alternative, the high frequency transmitting unit 7 and the high frequency receiving unit 9 may be disposed in parallel.

Further, in the above-mentioned example, the case in which the dielectric tube 2 has a monopole antenna shape is shown. Alternatively, the dielectric tube 2 can be formed into any shape if the condition that the dielectric tube is folded back such that its both ends are located below the ground conductor 1 is satisfied. Therefore, for example, the dielectric tube can be made to have any configuration suitable for operations as an antenna, such as a loop configuration, a helical configuration, or a folded-back and bent configuration. Further, in order to cause the dielectric tube 2 to have wide frequency hand characteristics, a tube having varying diameter can also be adopted for the dielectric tube 2, like in the case of a conical antenna and a taper antenna.

With respect to the region surrounding the dielectric tube 2 which is not shown in the drawings mentioned above, it is desirable that the dielectric tube 2 is enclosed with an electric insulation material. As the electric insulation material, a material having electric insulation, such as a high vacuum of 0.1 mPa or lower pressure, an inactive gas like a rare gas, the air, or SF6 having a pressure of 1 atmosphere or higher, a ceramic material like quartz, borosilicate glass or alumina, plastic like an acrylic resin, a composite material like carbon fiber reinforced plastic, or a material which is a combination of two or more of them, is used. In order to implement a low reflection cross-sectional area at a time when the antenna device is not used, it is preferable to use an inactive gas whose relative permittivity is close to that of a vacuum, a fluorine resin or carbon fiber reinforced plastic having a low relative permittivity, or the like. Further, by using plastic or a composite material, the resistance to shocks from outside the antenna device can be improved.

As explained above, the antenna device according to this Embodiment is configured in such a way that the first electrode terminals 3 and 4 for plasma excitation and the second electrode terminal 6 for high frequency power supply are disposed apart from each other, and the inner diameter of each of the both ends of the dielectric tube 2 is designed to be larger than that of the second electrode terminal 6. Consequently, it is not necessary to change the sizes of the first electrode terminals 3 and 9 in accordance with the wavelength of a high frequency signal, and a current adequate for causing the dielectric tube to operate as an antenna can be fed through the dielectric tube 2. Therefore, the antenna device can be made to have a low degree of interference with a radio wave at a time when the antenna device is not used, also high frequency band (e.g., a microwave band).

Namely, the antenna device according to the present invention operates as an antenna when the plasma excitation power supply 5 is turned ON, whereas the antenna device operates as an electrically-transparent device in the emission zone when the plasma excitation power supply 5 is turned OFF. Therefore, the antenna device does not become an interference source for adjacent antennas.

Further, according to conventional techniques, it is necessary to make the electrode terminals for plasma excitation finer for utilizing higher frequency, so that only a small amount of discharge power is supplied in order to excite plasma, in consideration of the durability of the electrode terminals. Therefore, a loss in the plasma conductor becomes large, and the amount of emission from the plasma conductor in the emission zone decreases. In contrast with this, because in the antenna device according to the present invention each of the first electrode terminals 3 and 4 for plasma excitation can be made to have a constant size independently on the frequency of the high frequency signal, a large amount of discharge power can be supplied in order to excite the plasma. Therefore, the antenna operation can be achieved with a small loss in the plasma conductor and without causing a decrease in the amount of emission in the emission zone.

Embodiment 2

In Embodiment 2, an antenna device that makes it possible to improve the antenna efficiency as compared with that according to Embodiment 1 will be shown.

Figure 4:
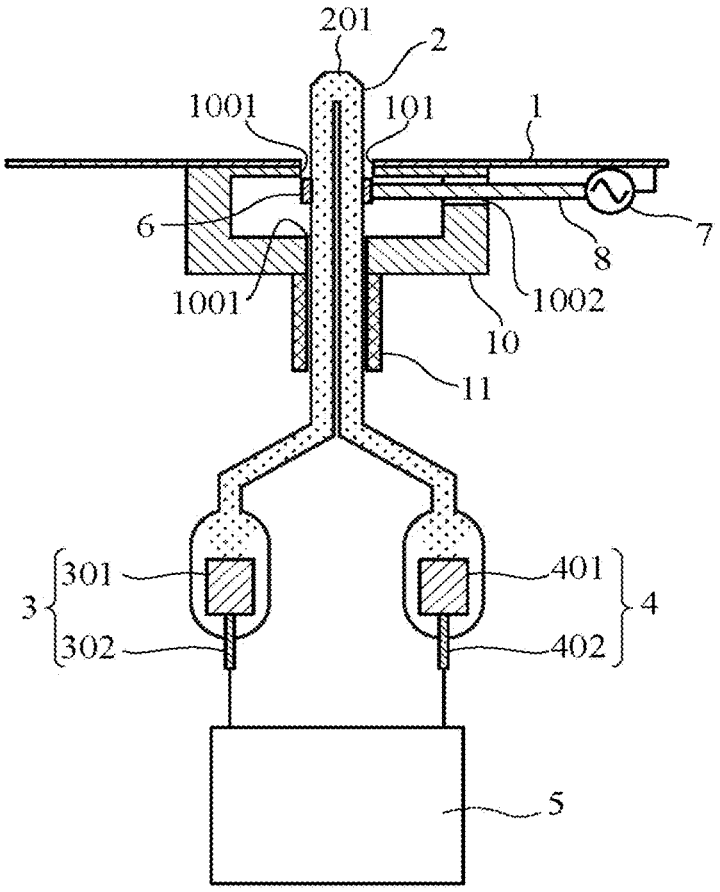
FIG. 4 is a cross-sectional view showing a configuration of an antenna device according to Embodiment 2 of the present invention.

FIG. 4 is a cross-sectional view showing the configuration of the antenna device according to Embodiment 2 of the present invention. The antenna device according to Embodiment 2 shown in this FIG. 4 includes a metal box 10 and a metal cylinder 11, in addition to the components of the antenna device according to Embodiment 1 shown in FIG. 1. The other fundamental components are the same as those according to Embodiment 1 and designated by the same reference numerals with Embodiment 1, and only different portions will be explained.

In the antenna device according to Embodiment 2, the metal box 10 for covering a second electrode terminal 6 is disposed, as shown in FIG. 4. This metal box 10 is a box-shaped member, and its upper surface is grounded to a lower surface of a ground conductor 1. Namely, the metal box 10 and the ground conductor 1 are electrically connected to each other, and are held at an ground potential of a high frequency signal. As a means of connecting between the metal box 10 and the ground conductor 1, for example, a typical connecting means, such as soldering, welding, or contact using screw clamp, can be used. As the material of the metal box 10, any material having a low resistance for the high frequency signal can be used. For example, a material, such as copper (Cu) or aluminum (Al), can be used. Further, holes 1001 for allowing a dielectric tube 2 to pass through the metal box 10 is formed in each of upper and bottom sides of the metal box 10. Further, a hole (which may be a notch groove) 1002 for allowing feed line 8 to pass through the metal box 10 is formed in a lateral side of the metal box 10. It is assumed that the sizes of the holes 1001 and 1002 are as small as possible.

Further, the inner length of the metal box 10 is designed to be equal to one-half or less of the wavelength of the high frequency signal, in order to prevent the high-order resonance of the high frequency signal within the metal box 10. In order to prevent the propagation of a radio wave to the downward direction of the dielectric tube 2, it is desirable that the gap between a bottom surface within the metal box 10 and a lower end of the second electrode terminal 6 is a quarter or less of the wavelength of the high frequency signal. Particularly in a case in which the gap between the bottom surface within the metal box 10 and the lower end of the second electrode terminal 6 is a quarter of the wavelength, the impedance of the bottom surface of the metal box 10 viewed from the second electrode terminal 6 is maximized, and therefore the propagation of a radio wave toward a portion lower than the bottom surface within the metal box 10 can be prevented at the maximum. The outer appearance of the metal box 10 can be formed to have any shape within a scope that the metal box 10 does not prevent the antenna operation of the antenna device.

Further, the metal cylinder 11 for enclosing a part of the dielectric tube 2 except both ends of the dielectric tube 2 is disposed below the metal box 10. The upper end of this metal cylinder 11 is grounded to an outer bottom surface of the metal box 10. Namely, the metal cylinder 11 and the metal box 10 are electrically connected to each other, and are held at the ground potential of the high frequency signal. As a means of connecting between the metal cylinder 11 and the metal box 10, for example, a typical connecting means, such as soldering, welding, fitting or screw clamp, can be used. As the material of the metal cylinder 11, any material having a low resistance for the high frequency signal can be used. For example, a material, such as copper (Cu) or aluminum (Al), can be used. Further, by using machining or the like, the metal box 10 and the metal cylinder 11 can be formed integrally. Further, it is assumed that the height of the metal cylinder 11 is a quarter or more of the wavelength of the high frequency signal. In order to prevent the propagation of a radio wave toward below the metal cylinder 11, the height of the metal cylinder 11 is preferable to be long as much as possible.

The metal box 10 and the metal cylinder 11 have only to act as an electric wall for reflecting a high frequency signal, so that a material, such as a metallic mesh or a punching plate, having a plurality of openings each having a size sufficiently smaller than the wavelength of the high frequency signal can be used for forming the metal box 10 or the metal cylinder 11. In order to enable the metal box 10 and the metal cylinder 11 to act as an electric wall, it is desirable that each of the plurality of openings has a diameter which is one-tenth or less of the wavelength of the high frequency signal. By using a material having openings, the weights of the metal box 10 and the metal cylinder 11 can be reduced.

Next, the principle of the operation of the antenna device according to Embodiment 2 shown in FIG. 4 will be explained. The operation of the antenna device at a time when a plasma excitation power supply 5 is turned OFF is the same as that in the configuration according to Embodiment 1, and only a case in which the plasma excitation power supply 5 is turned ON will be described hereafter.

When the plasma excitation power supply 5 is turned ON, electric power (low frequency power) for exciting plasma is supplied from the plasma excitation power supply 5 to first electrode terminals 3 and 4. The ionizing gas in the dielectric tube 2 then enters a plasma state, and the dielectric tube 2 serves as a conductor at high frequencies.

On the other hand, a high frequency signal from a high frequency transmitting unit 7 is supplied to the second electrode terminal 6 via the feed line 8. The high frequency signal supplied to the second electrode terminal 6 is supplied to the plasma in the dielectric tube 2 which becomes a state serving as a plasma conductor. The high frequency signal supplied to plasma propagates toward the upper and lower sides of the dielectric tube 2. The high frequency signal then forms a high frequency electromagnetic field between the plasma and the upper surface of the ground conductor 1, and is emitted into space as a radio wave.

On the other hand, many components of the high frequency signal propagating toward below the ground conductor 1 are reflected toward an upward direction of the ground conductor 1 due to the impedance mismatching at the inner bottom surface of the metal box 10. Further, components of the high frequency signal, the components passing through the inner bottom surface of the metal box 10, propagate while being confined between the metal cylinder 11 and the plasma, and are absorbed by the plasma without being emitted into space.

With this configuration, because only a portion of the dielectric tube 2 above the ground conductor 1 operates as an antenna, a larger part of the high frequency signal can be emitted from the portion above the ground conductor 1 so that the efficiency of the antenna can be improved.

Next, the effect of the metal box 10 and the metal cylinder 11 according to Embodiment 2 will be shown by using a simulation based on a finite difference time domain method.

Figure 5A:
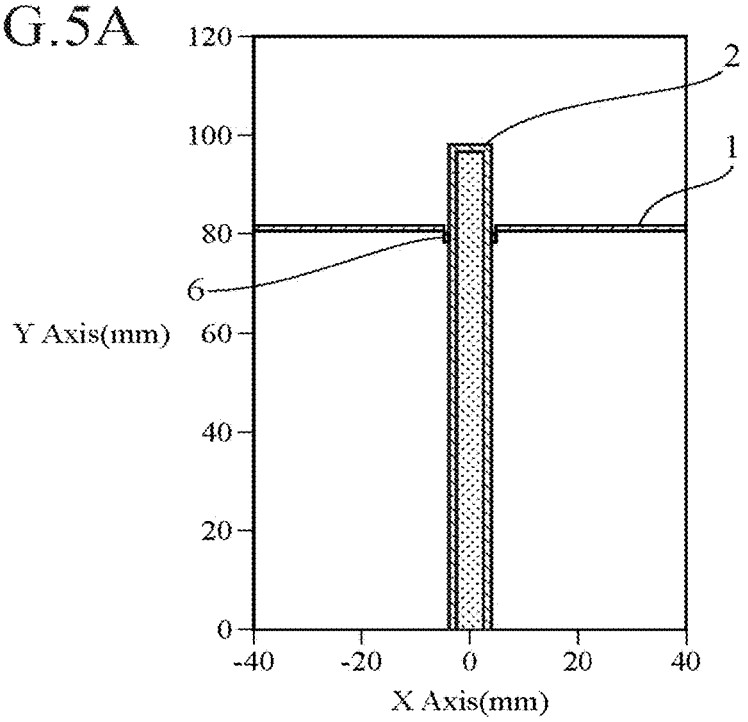
FIGS. 5A and 5B are diagrams showing a simulation for evaluating the propagation of a high frequency signal in the antenna device according to Embodiment 1 of the present invention.
Figure 5B:
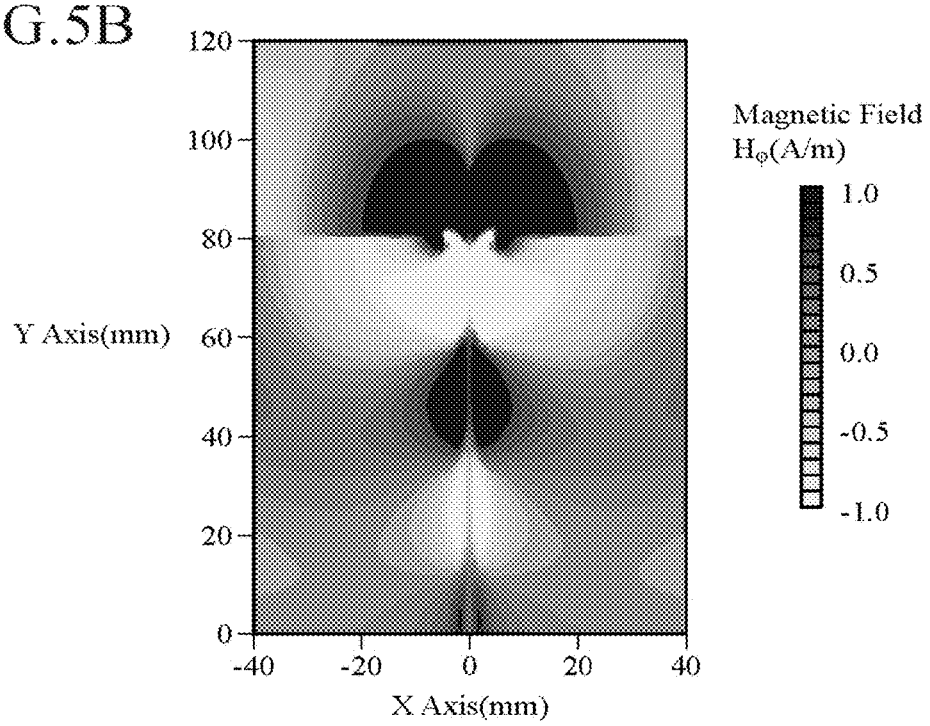
Figure 6A:
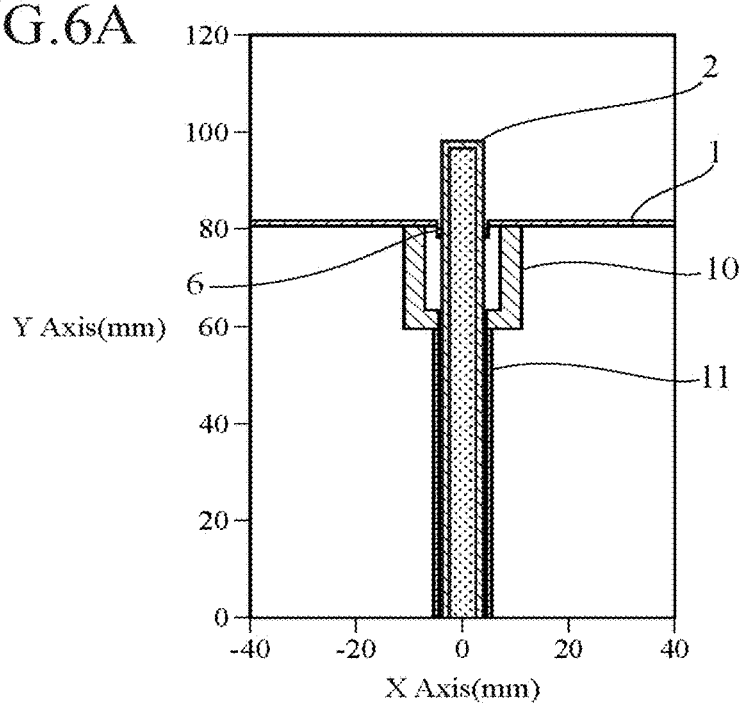
FIGS. 6A and 6B are diagrams showing simulation for evaluating the propagation of a high frequency signal in the antenna device according to Embodiment 2 of the present invention.
Figure 6B:
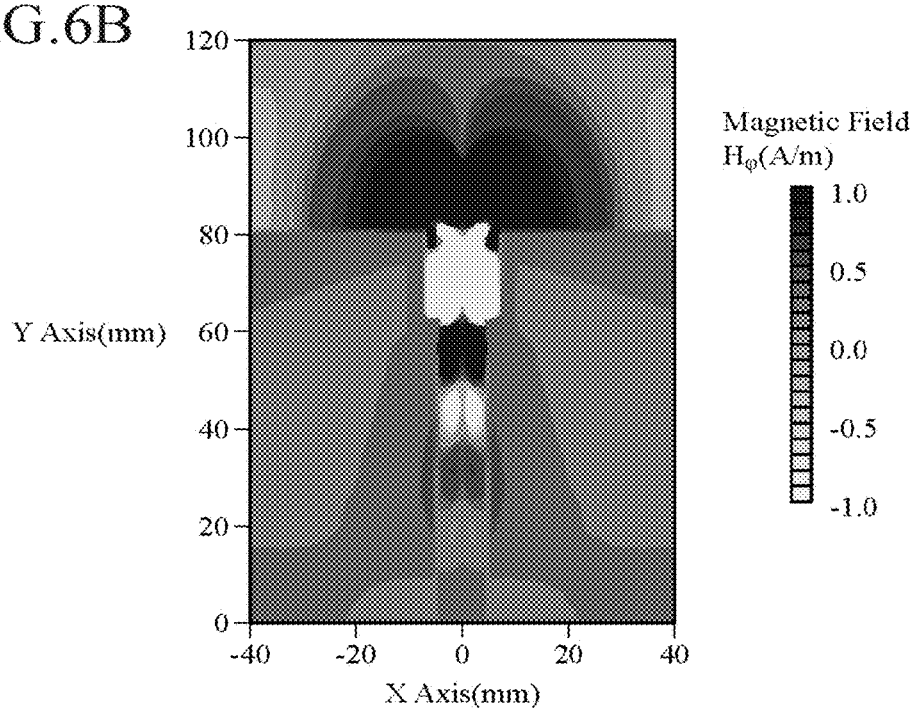

A simulation model of the antenna device according to Embodiment 1 which does not include the metal box 10 and the metal cylinder 11 is shown in FIG. 5A, and a result of the evaluation of the simulation model (a magnetic field distribution) is shown in FIG. 5B. A simulation model of the antenna device according to Embodiment 2 which includes the metal box 10 and the metal cylinder 11 is shown in FIG. 6A, and a result of the evaluation of the simulation model (a magnetic field distribution) is shown in FIG. 6B.

As shown in FIGS. 5A, 5B, 6A and 6B, in the simulation models, the axial direction of the dielectric tube 2 is defined as the vertical axis and the radial direction of the dielectric tube 2 is defined as the horizontal axis, and an analysis is carried out on a region near the second electrode terminal 6. The frequency of the high frequency signal is assumed to be 5 GHz. As plasma parameters, an electron density is set to 1E14 cm-3, and a collision frequency is set to 17 GHz. It is further assumed that the dielectric tube 2 is enclosed by the air. In order to simply explain the effect of the present invention, the simulation is carried out by assuming that the two dielectric tubes 2 which is a portion formed by folding a dielectric tube 2 and the plasma therein are equivalent to a single dielectric tube 2. This assumption does not have a significant influence on the effect according to the present invention.

Results of the simulation will be explained below.

As shown in FIG. 5R, in the antenna device according to Embodiment 1 which does not include the metal box 10 and the metal cylinder 11, the high frequency signal propagates, along the plasma, also toward a downward direction from the ground conductor 1 and a loss of the high frequency signal occurs in a portion below the ground conductor 1.

In contrast, as shown in FIG. 6B, in the antenna device according to Embodiment 2 which includes the metal box 10 and the metal cylinder 11, the high frequency signal does not propagate toward a downward direction from the ground conductor 1 due to the metal box 10 and the metal cylinder 11, and a loss of the high frequency power in a portion below the ground conductor 1 is prevented. As a result, a larger part of the high frequency signal propagates toward an upward direction from the ground conductor 1, and the dielectric tube 2 can operate as an antenna more efficiently.

Figure 7:
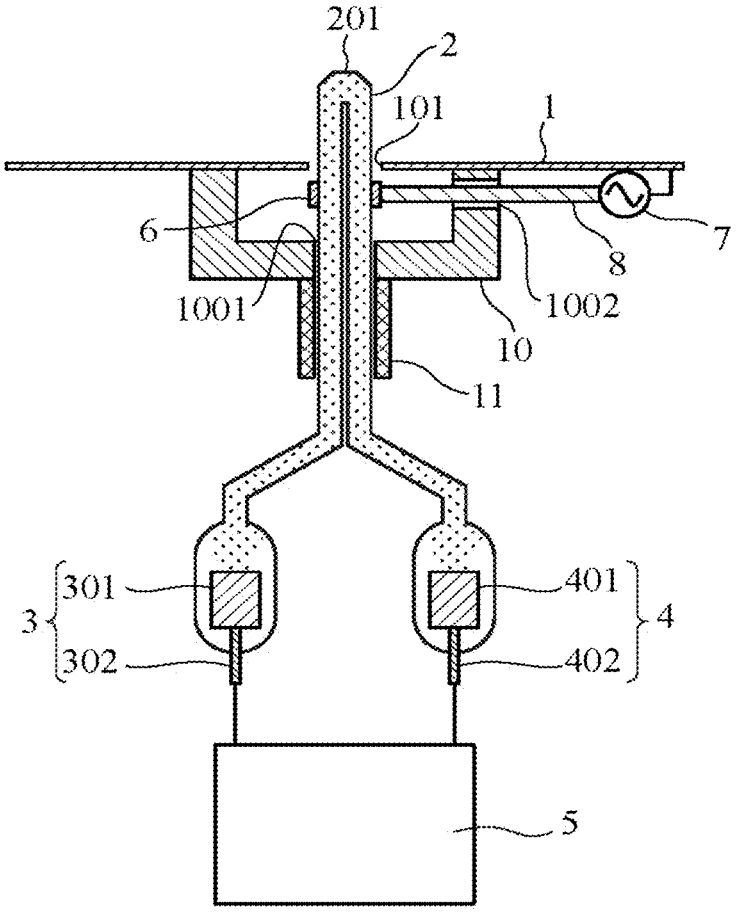
FIG. 7 is a cross-sectional view showing another example of a configuration of the antenna device according to Embodiment 2 of the present invention.

In the example of FIG. 4, the holes for allowing the dielectric tube 2 to pass through the metal box 10 are formed in the upper and lower sides of the metal box 10. Alternatively, the upper side of the metal box 10 can be eliminated and the ground conductor 1 can be made to serve as the upper side of the metal box 10, as shown in FIG. 7. By configuring the metal box in this way, the gap between the upper surface of the ground conductor 1 and the upper end of the second electrode terminal 6 can be minimized, and the characteristics of the antenna can be improved.

Figure 8:
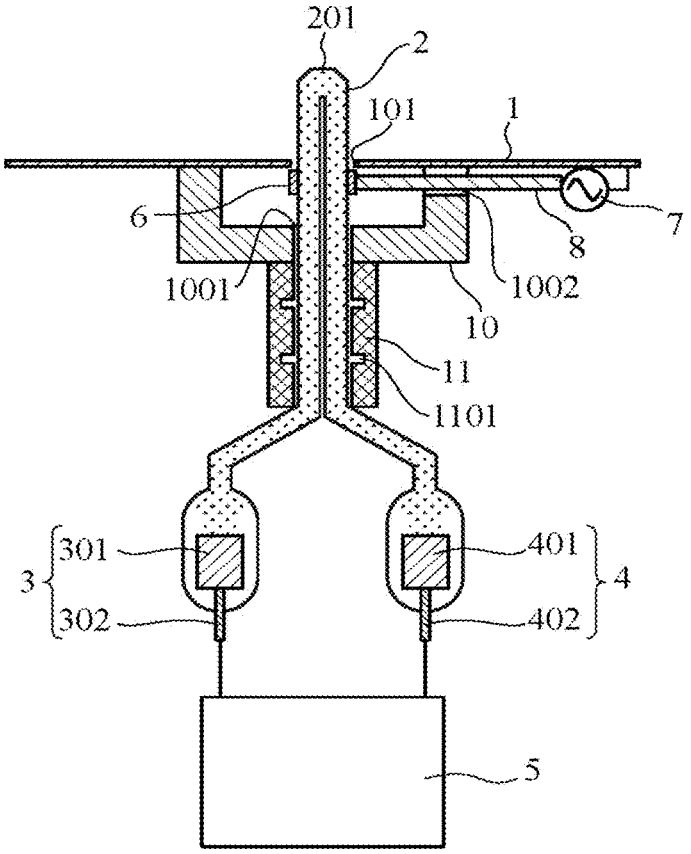
FIG. 8 is a cross-sectional view showing another example of a configuration of the antenna device according to Embodiment 2 of the present invention.

Further, in the example of FIG. 4, the metal cylinder 11 has an inner wall having a uniform inner diameter throughout its length. In contrast with this, as shown in FIG. 8, ring-shaped grooves 1101 may be formed in the inner wall of the metal cylinder 11 periodically along the axial direction of the metal cylinder 11, thereby changing the inner diameter of the metal cylinder 11. The change of the inner diameter of the metal cylinder 11 causes reflection of the high frequency signal due to impedance mismatching within the metal cylinder 11. As a result, a high frequency signal propagating toward the downward direction from the ground conductor 1 can be reduced, and the efficiency of the antenna can be further improved. Particularly in a case of forming the metal cylinder 11 in such a way that the inner diameter thereof is periodically changed at the interval of one-half of the wavelength of the high frequency signal, the reflection of the high frequency signal can be increased due to an electromagnetic band gap effect.

In the above example, the antenna device is used as a transmitting antenna device. Alternatively, the antenna device can be used as a receiving antenna device. In this case, either instead of the high frequency transmitting unit 7, or in parallel with the high frequency transmitting unit 7, a high frequency receiving unit 9 to receive a high frequency signal from the second electrode terminal 6 can be connected to the feed line 8.

As explained above, because the antenna device according to this Embodiment 2 includes the metal box 10 having the holes 1001 allowing the dielectric tube 2 to pass therethrough, covering the second electrode terminal 6, and grounded to the ground conductor 1, and the metal cylinder 11 grounded to the outer bottom surface of the metal box 10, and enclosing a portion of the dielectric tube 2 except the both ends of the dielectric tube 2, a portion of the dielectric tube 2 above the ground conductor 1 operates as an antenna. Therefore, the antenna device according to this Embodiment 2 can emit a larger part of a high frequency signal from the portion thereof above the ground conductor 1, and can further improve the efficiency of the antenna, as compared with that according to Embodiment 1.

By further forming ring-shaped grooves 1101 in the inner wall of the metal cylinder 11 periodically along the axial direction, the propagation of the high frequency signal toward a downward direction from the ground conductor 1 is prevented, thereby being able to further improve the efficiency of the antenna.

Embodiment 3

In Embodiment 3, an antenna device that can improve the antenna efficiency compared with the case of Embodiment 2 will be shown.

Figure 9:
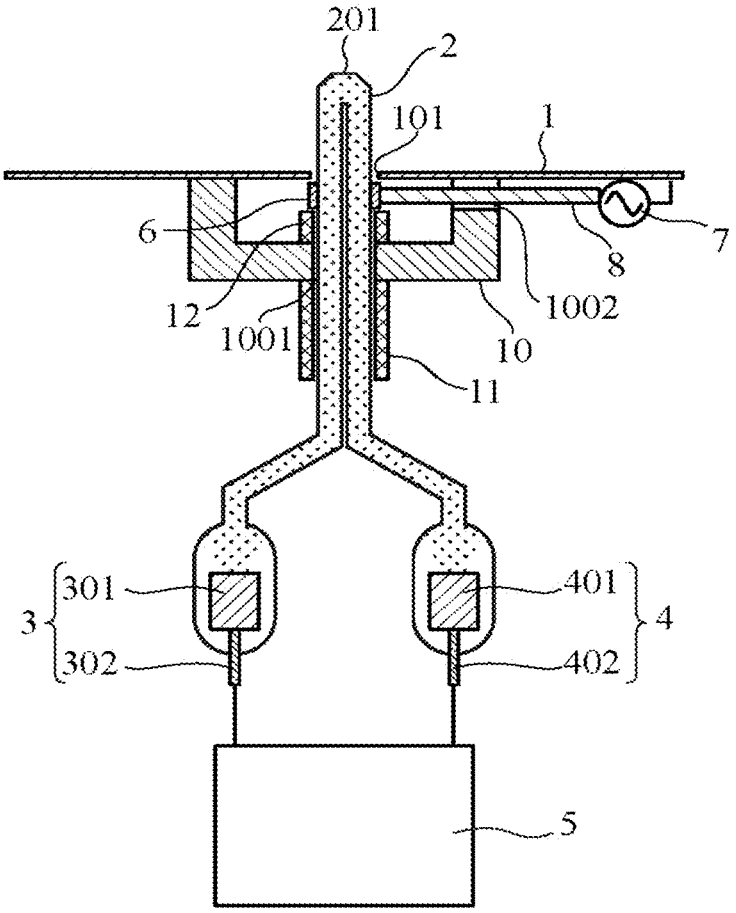
FIG. 9 is a cross-sectional view showing a configuration of an antenna device according to Embodiment 3 of the present invention.

FIG. 9 is a cross-sectional view showing the configuration of the antenna device according to Embodiment 3 of the present invention. The antenna device according to Embodiment 3 shown in this FIG. 9 includes a second metal cylinder 12 in addition to the components of the antenna device according to Embodiment 2 shown in FIG. 7. The other fundamental components are the same as those according to Embodiment 2 and designated by the same reference numerals with Embodiment 2, and only different portions will be explained.

In the antenna device according to Embodiment 3, the second metal cylinder 12 enclosing a dielectric tube is disposed within a metal box 10, as shown in FIG. 9. A bottom surface of this second metal cylinder 12 is grounded to an inner bottom surface of the metal box 10. Namely, the second metal cylinder 12 and the metal box 10 are electrically connected to each other, and are held at a ground potential of a high frequency signal. As a means of connecting between the second metal cylinder 12 and the metal box 10, for example, a typical connecting means, such as soldering, welding, fitting or screw clamp, can be used. Further, an upper end of the second metal cylinder 12 is located on the side of both ends of the dielectric tube 2 with respect to a second electrode terminal 6 (below the second electrode terminal). As the material of the second metal cylinder 12, any material having a low resistance for the high frequency signal can be used. For example, a material, such as copper (Cu) or aluminum (Al), can be used. Further, by using machining or the like, the metal box 10 and the second metal cylinder 12 (and the metal cylinder 11) can be formed integrally. Moreover, the height of the metal cylinder 12 is configured so as to be shorter than about the quarter of the wavelength of the high frequency signal.

The second metal cylinder 12 can be configured so as to have any thickness as long as the second metal cylinder 12 maintains a certain mechanical strength. The gap between a lower end of the second electrode terminal 6 and the upper end of the second metal cylinder 12 is made to be large than or equal to the gap between a lower surface of the ground conductor 1 and an upper end of the second electrode terminal 6.

As a result, a high frequency signal propagating, inside the metal box 10, along plasma toward a downward direction from the ground conductor 1 can be reduced, and the efficiency of the antenna can be improved.

The second metal cylinder 12 has only to act as an electric wall for reflecting the high frequency signal, and a material, as a metallic mesh or a punching plate, having a plurality of openings each having a size sufficiently smaller than the wavelength of the high frequency signal can be used. In order to enable the second metal cylinder to act as an electric wall, it is desirable that each of the plurality of openings has a diameter being one-tenth or less of the wavelength of the high frequency signal. By using a material having openings, the weight of the second metal cylinder 12 can be reduced.

In the above-explained example, the antenna device is used as a transmitting antenna device. Alternatively, the antenna device can be used as a receiving antenna device. In this case, either instead of a high frequency transmitting unit 7, or in parallel with the high frequency transmitting unit 7, a high frequency receiving unit 9 to receive a high frequency signal from the second electrode terminal 6 can be connected to a feed line 8.

As described above, the antenna device according to this Embodiment 3 includes the second metal cylinder 12 enclosing the dielectric tube 2 within the metal box 10, grounded to the inner bottom surface of the metal box 10, and having the upper end located at the side of both ends of the dielectric tube 2 with respect to the second electrode terminal 6. As a result, a high frequency signal propagating, inside the metal box 10, along plasma toward a downward direction from the ground conductor 1 can be reduced compared with Embodiment 2, and the efficiency of the antenna can be improved.

Embodiment 4

In Embodiment 4, an antenna device that can increase an upper limit on usable frequencies as compared with that according to Embodiment 2 will be shown.

Figure 10:
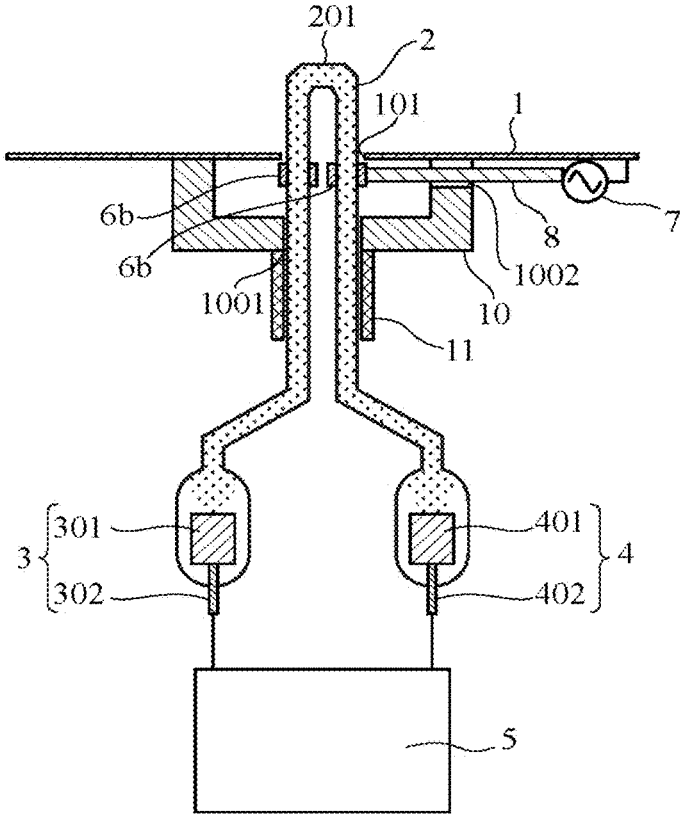
FIG. 10 is a cross-sectional view showing a configuration of an antenna device according to Embodiment 4 of the present invention.
Figure 11:
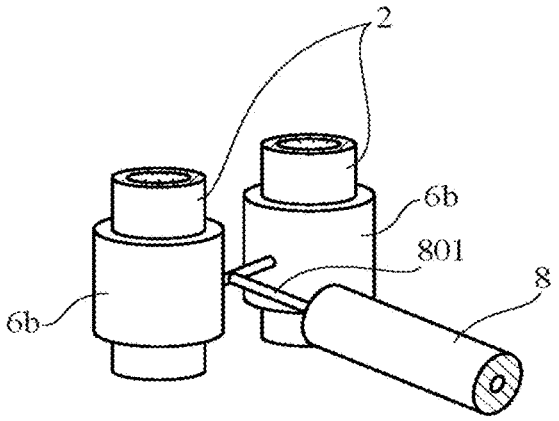
FIG. 11 is a schematic diagram showing a connecting portion between second electrode terminals and a feed line in the antenna device according to Embodiment 4 of the present invention.

FIG. 10 is a cross-sectional view showing a configuration of the antenna device according to Embodiment 4 of the present invention, and FIG. 11 is a schematic diagram showing connecting portion between second electrode terminals 6*b* and a feed line 8. In the antenna device according to Embodiment 4 shown in this FIG. 10, the second electrode terminals 6*b* are disposed instead of the second electrode terminal 6 of the antenna device according to Embodiment 2 shown in FIG. 7. The other fundamental components are the same as those according to Embodiment 2 and designated by the same reference numerals with Embodiment 2, and only different portions will be explained.

In the antenna device according to Embodiment 4, second electrode terminals 6*b* are disposed for two dielectric tubes 2, respectively, wherein the portion of the two dielectric tubes 2 is formed by folding a dielectric tube 2 at the folded-back portion 221. Namely, the pair of second electrode terminals 6*b* is fitted to two dielectric tubes 2 formed by folding the dielectric tube 2 and in contact with the outer surfaces of the two dielectric tubes 2, respectively, below the ground conductor 1. The gap between the ground conductor 1 and each of the second electrode terminals 6*b* is shortened within the limits in which the ground conductor 1 and the second electrode terminals 6 are not in contact with each other. Particularly, in order to supply a high frequency signal to plasma efficiently, it is preferable that the gap between the ground conductor 1 and each of the second electrode terminals 6 is one-twentieth or less of the wavelength of the high frequency signal.

Further, the gap between the second electrode terminals 6*b* is designed to be shorter than one-half of the wavelength of the high frequency signal, in order to prevent the resonance of the high frequency signal. In order to reduce the phase difference of the high frequency signals supplied to the pair of second electrode terminals 6*b*, it is preferable that the gap between the second electrode terminals 6*b* is one-tenth or less of the wavelength of the high frequency signal.

Further, the pair of second electrode terminal 6*b* is connected to the feed line 8 via an identical signal line 801, as shown in FIG. 11. The feed line 8 is connected to the second electrode terminals 6*b* via a connecting means of providing a low resistance for the high frequency signal. As the connecting means, for example, a typical connecting means, such as soldering, welding, or contact using screw clamp, can be used.

With this configuration, the sizes of the second electrode terminals 6*b* can be reduced and the resonance frequency of the second electrode terminals 6*b* can be raised. As a result, the upper limit on the frequencies which can be used by the antenna device can be increased.

In the above-explained example, the antenna device is used as a transmitting antenna device. Alternatively, the antenna device can be used as a receiving antenna device. In this case, either instead of a high frequency transmitting unit 7, or in parallel with the high frequency transmitting unit 7, a high frequency receiving unit 9 to receive a high frequency signal from the second electrode terminals 6 can be connected to the feed line 8.

As explained above, because the antenna device according to this Embodiment 4 is configured so as to include the second electrode terminals 6*b* for the two dielectric tubes 2 formed by folding a dielectric tube 2 at the folded-back portion 201, respectively, the sizes of the second electrode terminals 6*b* can be reduced and the resonance frequency of the second electrode terminals 6*b* can be raised as compared with those shown in Embodiment 2. Therefore, the upper limit on the frequency which can be used by the antenna device can be increased.

Further, according to the configuration in which the pair of second electrode terminals 6*b* is connected to the feed line 8 via the identical signal line 801, a monopole antenna with a small degree of interference with a radio wave at a time when the antenna device is not used, also in a high frequency band, can be provided.

Embodiment 5

Figure 12:
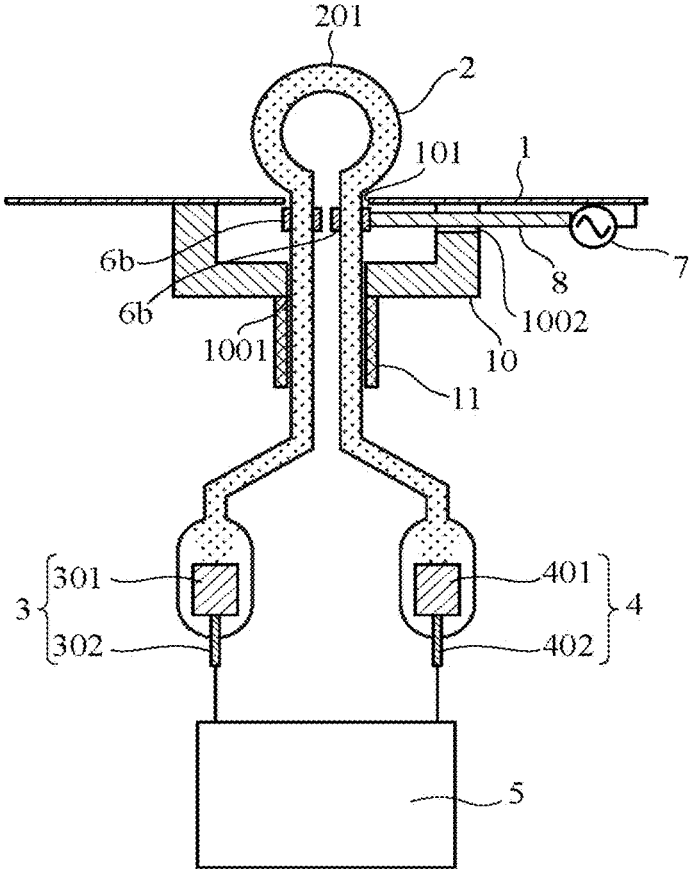
FIG. 12 is a cross-sectional view showing a configuration of an antenna device according to Embodiment 5 of the present invention.
Figure 13:
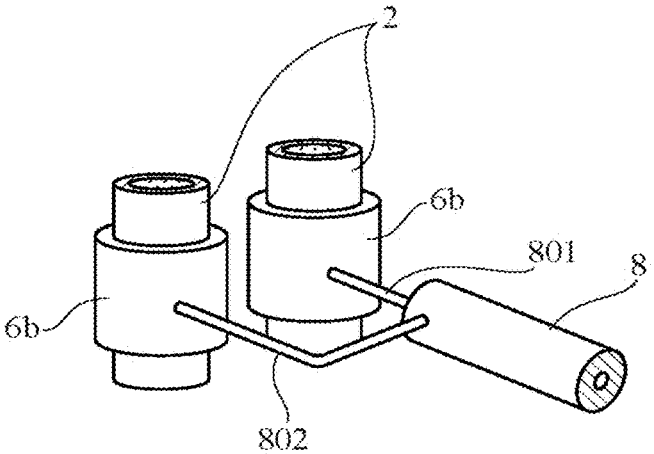
FIG. 13 is a schematic diagram showing a connecting portion between second electrode terminals and a feed line in the antenna device according to Embodiment 5 of the present invention.

FIG. 12 is a cross-sectional view showing the configuration of an antenna device according to Embodiment 5 of the present invention, and FIG. 13 is a schematic diagram showing a connecting portion of second electrode terminals 6*b* and a feed line 8. In the antenna device according to Embodiment 5 shown in these FIGS. 12 and 13, the plurality of second electrode terminal 6*b* of the antenna device according to Embodiment 4 shown in FIGS. 10 and 11 are connected to the feed line 8 via different signal lines 801 and 802, respectively. The other fundamental components are the same as those according to Embodiment 1 and designated by the same reference numerals with Embodiment 4, and only different portions will be explained. Note that, in Embodiment 5, a dielectric tube 2 is configured in the form of a loop antenna or folded dipole.

In the antenna device according to Embodiment 5, the second electrode terminals 6*b* are provided to be a pair and are connected to the feed line 8 via the different signal lines 801 and 802, respectively, as shown in FIG. 13. In the example of FIG. 13, one of the second electrode terminals 6*b* is connected to the feed line 8 via the first signal line 801, and the other second electrode terminal 6*b* is connected to the feed line 8 via the second signal line 802.

With this configuration, different signals can be supplied to the second electrode terminals 6*b*. Therefore, a loop antenna type or a folded dipole antenna type device with a small degree of interference with a radio wave at a time when the antenna is not used, also in a high frequency band, can be provided.

Note that, for example, when the second signal line 802 has a ground potential of a high frequency signal, instead of connecting the other second electrode terminal 6*b* and the second signal line 802, the second electrode terminal 6*b* can be connected to another structural member of the antenna device, the structural member having the ground potential of a high frequency signal, so that the resulting configuration is equivalent to the above-mentioned configuration.

In the above-mentioned example, the antenna device is used as a transmitting antenna device. Alternatively, the antenna device can be used as a receiving antenna device. In this case, either instead of a high frequency transmitting unit 7, or in parallel with the high frequency transmitting unit 7, a high frequency receiving unit 9 to receive a high frequency signal from the second electrode terminals 6 can be connected to the feed line 8.

As explained above, in the antenna device according to this Embodiment 5, the pair of second electrode terminals 6*b* is connected to the feed line 8 via the different signal lines 801 and 802, respectively. As a result, a loop antenna type or a folded dipole type antenna device with a small degree of interference, as compared with that shown in Embodiment 2, with a radio wave at a time when the antenna device is not used, also in a high frequency band, can be provided.

It is to be understood that any combination of two or more of the above-mentioned embodiments can be made, various modifications can be made in any component of the above-mentioned embodiments, and any component of the above-mentioned embodiments can be omitted within the scope of the invention.

INDUSTRIAL APPLICABILITY

The present invention can be preferably applied to various antenna devices in which the size of each electrode terminal used for plasma excitation is not required to be changed in accordance with the wavelength of a high frequency signal, a current adequate for causing the dielectric tube to operate as an antenna can be fed through the dielectric tube, and the interference with a radio wave is reduced at a time when the antenna device is not used.

REFERENCE SIGNS LIST

1 ground conductor, 2 dielectric tube, 3, 4 first electrode terminal, 5 plasma excitation electric power supply, 6, 6*b* second electrode terminal, 7 high frequency transmitting unit, 8 feed line, 9 high frequency receiving unit, 10 metal box, 11 metal cylinder, 12 second metal cylinder, 101 hole, 201 folded-back portion, 301, 401 discharge electrode, 302, 402 lead line, 801 first signal line, 802 second signal line, 1001, 1002 hole, and 1101 groove.

The invention claimed is:

1. An antenna device comprising:

a ground conductor;

a dielectric tube in which an ionizing gas is contained and having a folded-back portion, with both ends of the dielectric tube being directed toward an identical direction, and being arranged to pass through the ground conductor in such a way that the folded-back portion and the both ends are disposed in different sides of the ground conductor;

first electrode terminals disposed at the both ends of the dielectric tube, respectively;

a plasma excitation power supply connected to the first electrode terminals and bringing the ionizing gas into a plasma state;

a second electrode terminal ring-shaped and fitted to an outer peripheral surface portion of the dielectric tube between the ground conductor and the both ends of the dielectric tube in such a way as to be in contact with the outer peripheral surface portion, wherein the second electrode terminal is different from the first electrode terminals, and the second electrode terminal is disposed for each of two dielectric tubes, wherein a portion of the two dielectric tubes is formed by folding the dielectric tube at the folded-back portion;

a high frequency transmitter grounded to the ground conductor and supplying a high frequency signal to the second electrode terminal; and a feed line connecting between the second electrode terminal and the high frequency transmitter, wherein each of the both ends of the dielectric tube has an inner diameter larger than an inner diameter of the second electrode terminal.

2. The antenna device according to claim 1, wherein the second electrode terminal is disposed to each of the two dielectric tubes, and is connected to the feed line via an identical signal line.

3. The antenna device according to claim 1, wherein the second electrode terminal disposed to each of the two dielectric tubes is connected to the feed line via a signal line different to each other.

4. The antenna device according to claim 1, wherein said antenna device further comprising: a metal box having a hole through which the dielectric tube passes through, covering said second electrode terminal, and grounded to said ground conductor; and a metal cylinder enclosing a part of said dielectric tube except the both ends of said dielectric tube, and grounded to an outer bottom surface of said metal box.

5. The antenna device according to claim 4, wherein ring-shaped grooves are formed in an inner wall of said metal cylinder periodically along an axial direction of the metal cylinder.

6. The antenna device according to claim 4, wherein said antenna device further comprising a second metal cylinder enclosing said dielectric tube in said metal box, grounded to an inner bottom surface of said metal box, and having an upper end located at the side of the both ends of said dielectric tube from said second electrode terminal.

7. The antenna device according to claim 1, wherein when the plasma excitation power supply brings the ionizing gas into the plasma state, the second electrode terminal performs supplying of the high frequency signal which is supplied by the high frequency signal transmitter to the ionizing gas, and a portion between the folded-back portion and the ground conductor of the dielectric tube performs emitting of a radio wave to a space in accordance with the high frequency signal supplied to the ionizing gas, and when the plasma excitation power supply does not brings the ionizing gas into the plasma state, the second electrode terminal suppress the supplying to the ionizing gas, and the emitting of the radio wave to the space by the portion between the folded-back portion and the ground conductor is suppressed.

8. An antenna device comprising:

a ground conductor;

a dielectric tube in which an ionizing gas is contained and having a folded-back portion, with both ends of the dielectric tube being directed toward an identical direction, and being arranged to pass through the ground conductor in such a way that the folded-back portion and the both ends are disposed in different sides of the ground conductor;

first electrode terminals disposed at the both ends of the dielectric tube, respectively;

a plasma excitation power supply connected to the first electrode terminals and bringing the ionizing gas into a plasma state;

a second electrode terminal ring-shaped and fitted to an outer peripheral surface portion of the dielectric tube between the ground conductor and the both ends of the dielectric tube in such a way as to be in contact with the outer peripheral surface portion, wherein the second electrode terminal is different from the first electrode terminals, and the second electrode terminal is disposed for each of two dielectric tubes, wherein a portion of the two dielectric tubes is formed by folding the dielectric tube at the folded-back portion;

a high frequency receiver grounded to the ground conductor and receiving a high frequency signal from the second electrode terminal; and a feed line connecting between the second electrode terminal and the high frequency receiver, wherein each of the both ends of the dielectric tube has an inner diameter larger than an inner diameter of the second electrode terminal.

9. The antenna device according to claim 8, wherein the second electrode terminal is disposed to each of the two dielectric tubes, and is connected to the feed line via an identical signal line.

10. The antenna device according to claim 8, wherein the second electrode terminal disposed to each of the two dielectric tubes is connected to the feed line via a signal line different to each other.

11. The antenna device according to claim 8, wherein said antenna device further comprising: a metal box having a hole through which the dielectric tube passes through, covering said second electrode terminal, and grounded to said ground conductor; and a metal cylinder enclosing a part of said dielectric tube except the both ends of said dielectric tube, and grounded to an outer bottom surface of said metal box.

12. The antenna device according to claim 11, wherein ring-shaped grooves are formed in an inner wall of said metal cylinder periodically along an axial direction of the metal cylinder.

13. The antenna device according to claim 11, wherein said antenna device further comprising a second metal cylinder enclosing said dielectric tube in said metal box, grounded to an inner bottom surface of said metal box, and having an upper end located at the side of the both ends of said dielectric tube from said second electrode terminal.

14. The antenna device according to claim 8, wherein when the plasma excitation power supply brings the ionizing gas into the plasma state, a portion between the folded-back portion and the ground conductor of the dielectric tube performs receiving of a radio wave supplied from a space to the ionizing gas, and the second electrode terminal performs supplying of the high frequency signal to the high frequency receiver in accordance with the radio wave received by the portion between the folded-back portion and the ground conductor, and when the plasma excitation power supply does not brings the ionizing gas into the plasma state, the receiving of the radio wave from the space by the portion between the folded-back portion and the ground conductor is suppressed, and the second electrode terminal suppress the supplying to the high frequency receiver.

* * * * *